US009486696B2

(12) United States Patent
Buckhault et al.

(10) Patent No.: US 9,486,696 B2
(45) Date of Patent: Nov. 8, 2016

(54) BILLIARDS PLAYING AID

(71) Applicants: Chad Kirby Buckhault, Baton Rouge, LA (US); Debbie Ann Kovac, Baton Rouge, LA (US)

(72) Inventors: Chad Kirby Buckhault, Baton Rouge, LA (US); Debbie Ann Kovac, Baton Rouge, LA (US)

( * ) Notice: Subject to any disclaimer, the term of this patent is extended or adjusted under 35 U.S.C. 154(b) by 0 days.

(21) Appl. No.: 14/255,678

(22) Filed: Apr. 17, 2014

(65) Prior Publication Data

US 2015/0297977 A1 Oct. 22, 2015

(51) Int. Cl.
*A63D 15/10* (2006.01)
*A63D 15/00* (2006.01)

(52) U.S. Cl.
CPC ..... *A63D 15/105* (2013.01); *A63D 15/10* (2013.01)

(58) Field of Classification Search
CPC .. A63D 15/105; A63D 15/10; A63D 15/006; A63D 15/08; A41D 13/087; A63B 71/148
USPC ..... 473/422, 43, 42; D21/726, 782
See application file for complete search history.

(56) References Cited

U.S. PATENT DOCUMENTS

| | | | | | |
|---|---|---|---|---|---|
| 242,877 | A | * | 6/1881 | Bryant | 473/43 |
| 570,459 | A | | 11/1896 | Cronin | |
| 953,167 | A | * | 3/1910 | Furey | 473/43 |
| 1,105,478 | A | * | 7/1914 | Ames | 473/43 |
| 1,149,834 | A | | 8/1915 | James | |
| 3,563,543 | A | * | 2/1971 | Hamilton et al. | 473/43 |
| 4,053,153 | A | * | 10/1977 | Josenhans | 473/43 |
| 4,210,325 | A | | 7/1980 | McCann | |
| D317,808 | S | * | 6/1991 | Reyes | D21/726 |
| D485,319 | S | * | 1/2004 | Keller | D21/726 |
| 2015/0065262 | A1 | * | 3/2015 | Lucero | 473/43 |
| 2015/0297977 | A1 | * | 10/2015 | Buckhault | A63D 15/105 473/43 |

FOREIGN PATENT DOCUMENTS

| | | | | |
|---|---|---|---|---|
| GB | 2428384 | A * | 1/2007 | A63D 15/105 |
| GB | 2437181 | A * | 10/2007 | A63D 15/105 |

* cited by examiner

*Primary Examiner* — Mitra Aryanpour
(74) *Attorney, Agent, or Firm* — Dunlap Bennett & Ludwig PLLC

(57) ABSTRACT

A billiards playing aid is provided. The billiards playing aid includes a guide tray with a channel formed to receive a cue stick. At least one finger support such as a middle finger support and a ring finger support may extend from the side of the guide tray. The finger supports may each form a hole for a user to fit their fingers within.

5 Claims, 3 Drawing Sheets

BILLIARDS PLAYING AID

BACKGROUND OF THE INVENTION

The present invention relates to a training and playing device and, more particularly, to a billiard training and playing device with an elevated bridge.

Cue sports, also known as billiard sports, are a wide variety of games of skill generally played with a cue stick which is used to strike billiard balls, moving them around a cloth-covered billiards table bounded by rubber cushions. In Billiards, placing the hand in the correct and most stable bridge to guide the stick straight and make contact with the cue-ball is very difficult for inexperienced players. Further, in situations where the cue ball is next to and/or in front of another ball, making frontal impact of the ball impossible, and an elevated bridge is needed in order to make the shot.

As can be seen, there is a need for a billiards training and playing device.

SUMMARY OF THE INVENTION

In one aspect of the present invention, a billiards playing aid comprises: an elongated guide tray comprising a front end, a rear end, a first side, a second side, a top surface and a bottom surface, wherein the top surface comprises a channel formed to receive a cue stick; and at least one finger support extending the at least one of the first side and the second side, wherein the finger support forms a hole formed to fit a finger within.

In another aspect of the present invention, a billiards playing aid comprises: a guide tray comprising a front end, a rear end, a first side, a second side, a top surface and a bottom surface, wherein the top surface comprises a channel formed to receive a cue stick; and a middle finger support and a ring finger support extending from the at least one of the first side and the second side, wherein the middle finger support forms a hole formed to fit a middle finger within, and the ring finger forms a hole formed to fit a ring finger within.

In another aspect of the present invention, a method of learning how to properly hold a cue stick comprises: providing billiards playing aid comprising a guide tray, and a middle finger support and a ring finger support extending from the guide tray; placing a middle finger through the middle finger support and a ring finger through the ring finger support; placing a cue stick within a channel of the guide tray; and positioning an index finger over the cue stick and the channel.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a hand held training and playing guide with an elevated bridge. The present invention places a user's fingers and hand into the correct position creating the perfect bridge to guide the cue stick straight. The present invention trains a person to form their hand into the correct position to hold and guide the cue stick while holding it with their other hand to make their shot count. The present invention also serves as an elevated bridge for the user to be able to make contact with the cue ball over and/or around a ball in the way of the cue ball.

Figure 1:
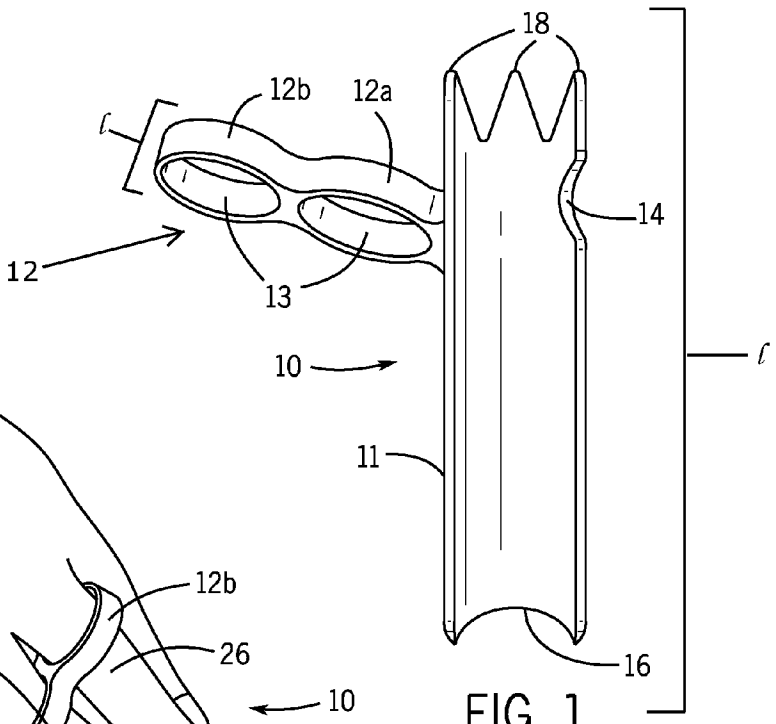
FIG. 1 is a perspective view of the present invention.
Figure 2:
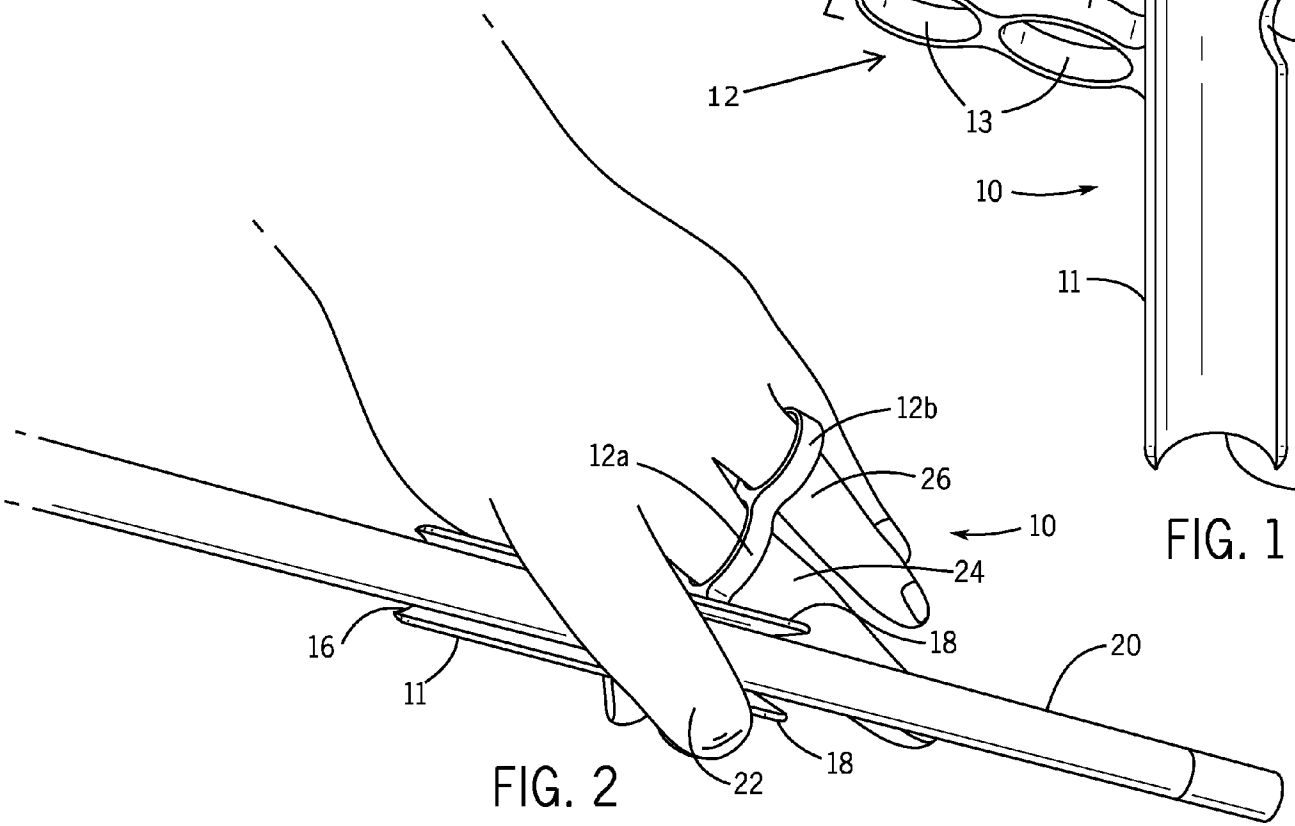
FIG. 2 is a top perspective view of the present invention in use in a first mode.
Figure 3:
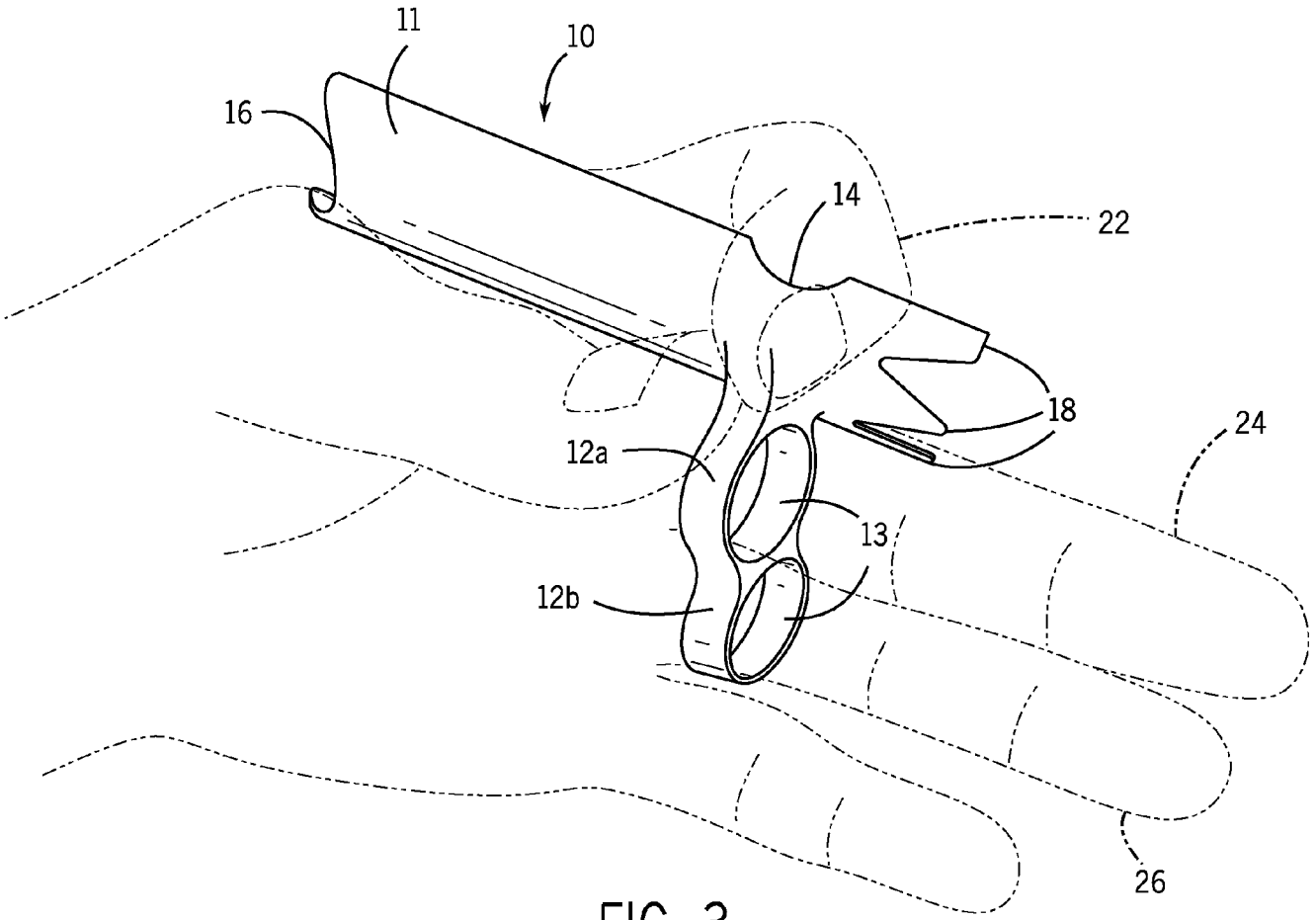
FIG. 3 is a bottom perspective view of the present invention in use in the normal bridge training mode.
Figure 4:
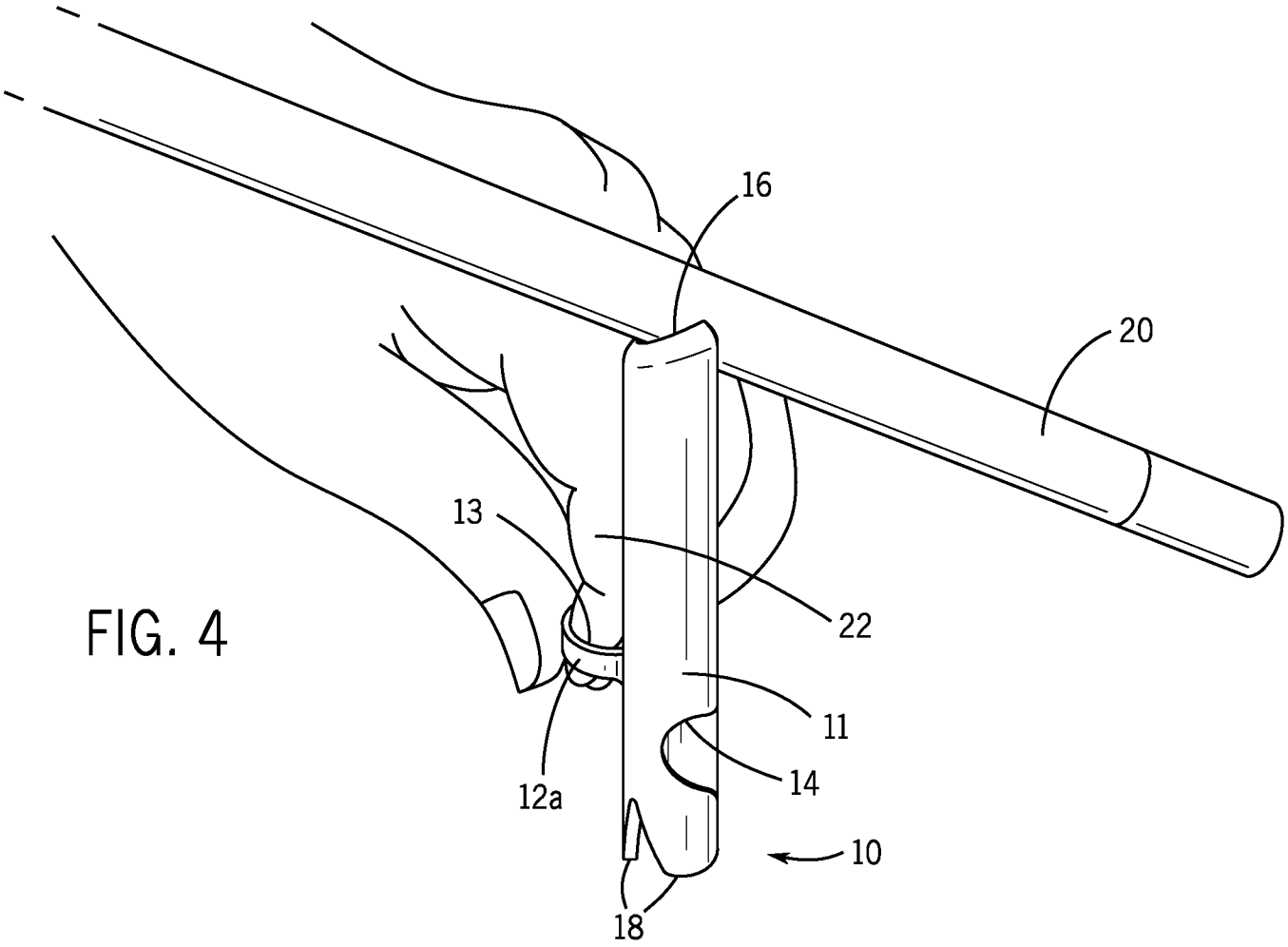
FIG. 4 is a front perspective view of the present invention in use in the elevated bridge mode.

Referring to FIGS. 1 through 4, the present invention includes a billiards playing aid 10. The billiards playing aid 10 includes a guide tray 11 having a front end, a rear end, a first side, a second side, a top surface, and a bottom surface. The top surface includes a channel formed to receive a cue stick 20. In certain embodiments, the present invention may include at least one finger support 12. The finger support 12 may extend from either or both of the first side and the second side. The finger support 12 may form a hole 13 for a user to fit their finger 22, 24, 26 within.

In certain embodiments, the guide tray 11 may have a length (l) that is substantially greater than the length (l) of the finger support 12. Therefore, the guide tray 11 may be elongated and support the cue stick 20 at a correct angle relative to the user's hand. In certain embodiments, the finger support 12 may extend from the side of the guide tray 11 and may be substantially perpendicular relative to the guide tray 11. As illustrated in the Figures, the finger support 12 may be at an angle relative to the guide tray 11 slanting towards the front end of the guide tray 11 to place the user's hand in a correct position while playing pool.

In certain embodiments, the at least one finger support 12 may include a plurality of finger supports 12. For example, the present invention may include a middle finger support 12*a* and a ring finger support 12*b* so that a user may place their middle finger 24 within the middle finger support 12*a* and the ring finger 26 within the ring finger support 12*b*. The guide tray 11 may further include a finger notch 14 formed on the opposite side of the finger supports 12. In such embodiments, the user may place the cue stick 20 within the channel of the guide tray 11 and wrap the index finger 22 around the top of the cue stick 20. The user may then rest the index finger 22 within the finger notch 14.

The present invention may further include an alternate use as an elevated bridge. In such embodiments, the first end of the guide tray 11 may include a plurality of protruding feet 18 so that the first end of the guide tray 11 may be stabilized on a surface. For example, the first end may include three protruding feet 18. The present invention may further include a curved guide 16 formed at the edge of the second end of the guide tray 11. The curved guide 16 may be a curve recessing towards the first end of the guide tray 11. Therefore, a user may place the protruding feet 18 on a surface and place the cue stick 20 on the curved guide 16 to take a difficult pool shot.

A method of learning how to properly hold a cue stick may include the following. Using the billiards playing aid 10, place a middle finger 24 through the middle finger support 12*a* and a ring finger 26 through the ring finger support 12*b*. Then place a cue stick 20 within the channel of the guide tray 11. Then the user may position their index finger 22 over the cue stick 20 and the channel, wrapping their index finger 22 around the cue stick 20. In certain embodiments, the user may rest their index finger 22 within the notch 14 and the thumb may be placed underneath the guide tray 11 to make contact with the index finger 22.

A method of using the billiards playing aid 10 as elevated bridge may include the following. The user may place a top portion of an index finger 22 in the middle finger support 12*a* and place a top portion of the middle finger 14 in the ring finger support 12*b*. The user may then place the guide tray 11 vertically on a surface so that the front end of the guide tray 11 is resting on the surface. The user may then rest the cue stick 20 on a rear end of the guide tray 11, such as within the curved guide 16. Then the user may hit their shot.

A method of making the present invention may include the following. The middle finger support 12*a*, the ring finger support 12*b*, and the guide tray 11 may be cast of plastic and molded into the correct angles to form the hand into the perfect bridge to guide the cue stick straight. However, the present invention is not limited to the above mentioned method.

It should be understood, of course, that the foregoing relates to exemplary embodiments of the invention and that modifications may be made without departing from the spirit and scope of the invention as set forth in the following claims.

What is claimed is:

1. A billiards playing aid comprising:

an elongated guide tray comprising a length greater than a width and having a front end and a rear end forming the length therebetween, a first side, a second side, a top surface and a bottom surface, wherein the top surface comprises a half pipe shape forming a channel running along the entire length and formed to receive a cue stick;

at least one finger support extending from the first side, wherein the finger support forms a hole formed to fit a finger within; and a finger notch formed on an upper edge of the channel on the second side of the elongated guide tray opposite the at least one finger support.

2. The billiards playing aid of claim 1, wherein the at least one finger support comprises a plurality of finger supports.

3. The billiards playing aid of claim 2, wherein the plurality of finger supports comprise a middle finger support and a ring finger support.

4. The billiards playing aid of claim 1, wherein the second end comprises a curved guide formed to receive a cue stick.

5. The billiards playing aid of claim 4, wherein the first end comprises a plurality of protruding feet.

* * * * *